US005588219A

United States Patent [19]

Seabrooks

[11] Patent Number: 5,588,219

[45] Date of Patent: Dec. 31, 1996

[54] ROLLED SHEET MATERIAL HAVING RELEASABLE ANTI-TACK GUIDE STRIP

[76] Inventor: Jeffrey A. Seabrooks, 1316 Coronado Blvd., Reynoldsburg, Ohio 43068

[21] Appl. No.: 292,935

[22] Filed: Aug. 18, 1994

[51] Int. Cl.[6] ..... B65H 61/00

[52] U.S. Cl. ..... 33/733; 242/563.2

[58] Field of Search ..... 242/1, 160.1, 160.2, 242/160.4, 530.2, 534.2, 563.2, 444.1, 444.2, 444.3, 602, 602.1, 536, 602.2; 33/733; 206/412

[56] References Cited

U.S. PATENT DOCUMENTS

| | | | |
|---|---|---|---|
| 188,279 | 3/1877 | Bond | 33/733 |
| 230,937 | 8/1880 | Hammond | 33/733 X |
| 879,846 | 2/1908 | Bayless et al. | 33/733 |
| 1,613,858 | 1/1927 | Vogl | 33/733 |
| 2,288,801 | 7/1942 | Goldsmith | 33/733 |
| 3,495,785 | 2/1970 | Coleman | 242/536 |

FOREIGN PATENT DOCUMENTS

| | | | |
|---|---|---|---|
| 2052202 | 8/1971 | Germany | 242/536 |

*Primary Examiner*—John M. Jillions
*Attorney, Agent, or Firm*—Standley & Gilcrest

[57] ABSTRACT

The present invention, in broadest terms is a rolled sheet material having a guide strip, comprising: (a) a rolled sheet material having a lateral width, lateral sides, lateral edges and a longitudinal axis; and (b) a guide strip disposed along one lateral side of the rolled sheet material, the guide strip being releasable from the rolled sheet material and having a lateral width less than the lateral width of the rolled sheet material.

6 Claims, 7 Drawing Sheets

ROLLED SHEET MATERIAL HAVING RELEASABLE ANTI-TACK GUIDE STRIP

TECHNICAL FIELD

The present invention is a rolled sheet material having a releasable anti-tack guide strip.

BACKGROUND

Many sheet materials are packaged in and dispensed from a rolled form, particularly in household settings or in laboratories. Such materials may include foil and a wide variety of plastic films.

A principal problem in dispensing rolled sheet materials by hand is that many such materials develop static or have a natural tack, making separation of the terminal end of the rolled sheet material difficult, when initiating dispensing. Normally, the user must use the fingernail or other thin or sharp tool to separate the terminal end of the rolled sheet material. Use of such a tool can lead to fraying of the terminal end and or lengthwise tearing of the material, causing waste.

Another problem often encountered is that the texture, transparency or other characteristic of the rolled sheet material makes it difficult to visually or even tactilely locate the terminal end of the rolled sheet material to initiate unrolling. This difficulty can waste time and can be frustrating to the user.

Accordingly, it is desirable to be able to produce a rolled sheet material which overcomes the problems associated with rolled materials which are tacky and or have characteristics which make visual or tactile clues to the position of the terminal end of the rolled material.

Additional advantages or the solution to other problems may become apparent to one of ordinary skill in the art from the present disclosure or through practice of the present invention.

SUMMARY OF THE INVENTION

The present invention, in broadest terms is a rolled sheet material having a guide strip, comprising: (a) a rolled sheet material having a lateral width, lateral sides, lateral edges and a longitudinal axis; and (b) a guide strip disposed along one lateral side of the rolled sheet material, the guide strip being releasable from the rolled sheet material and having a lateral width less than the lateral width of the rolled sheet material.

The rolled sheet material may be of any material where dispensing from a rolled form is problematic, such as in the dispensing of aluminum foil, waxed paper and polymeric sheet materials, such as cellophane or laboratory film.

It is preferred that the guide strip be of a material heavier and less prone to the holding of a static charge than the rolled sheet material itself, to make handling easier.

It is also preferred that the guide strip is adhered to the rolled sheet material by a releasable adhesive.

The guide strip may be arranged so as to be substantially parallel to the longitudinal axis of the rolled sheet material. However, in many cases where the guide strip is of a weight and thickness which makes it of a substantial thickness when rolled, it will be preferred to have the guide strip be coiled so as to be substantially uniformly distributed between the lateral edges of the rolled sheet material.

Another improved embodiment can be made by supplying the guide strip with indicia, particularly indicia that indicates the length of the rolled sheet material being dispensed. This can even be done in the case where the guide strip is coiled, by calculating the equivalent length of the straight length of the rolled sheet material to that of the coiled guide strip. Such indicia may include rulings, numbers, designs, grids, etc.

DETAILED DESCRIPTION OF THE PREFERRED EMBODIMENT

The following describes and illustrates two embodiments of the present invention. The embodiment shown in FIG. 1–3 being the first embodiment of the present invention, and the embodiment shown in FIGS. 5–7 being the second and most preferred embodiment of the present invention; and which is also the best mode of the present invention.

Figure 1:
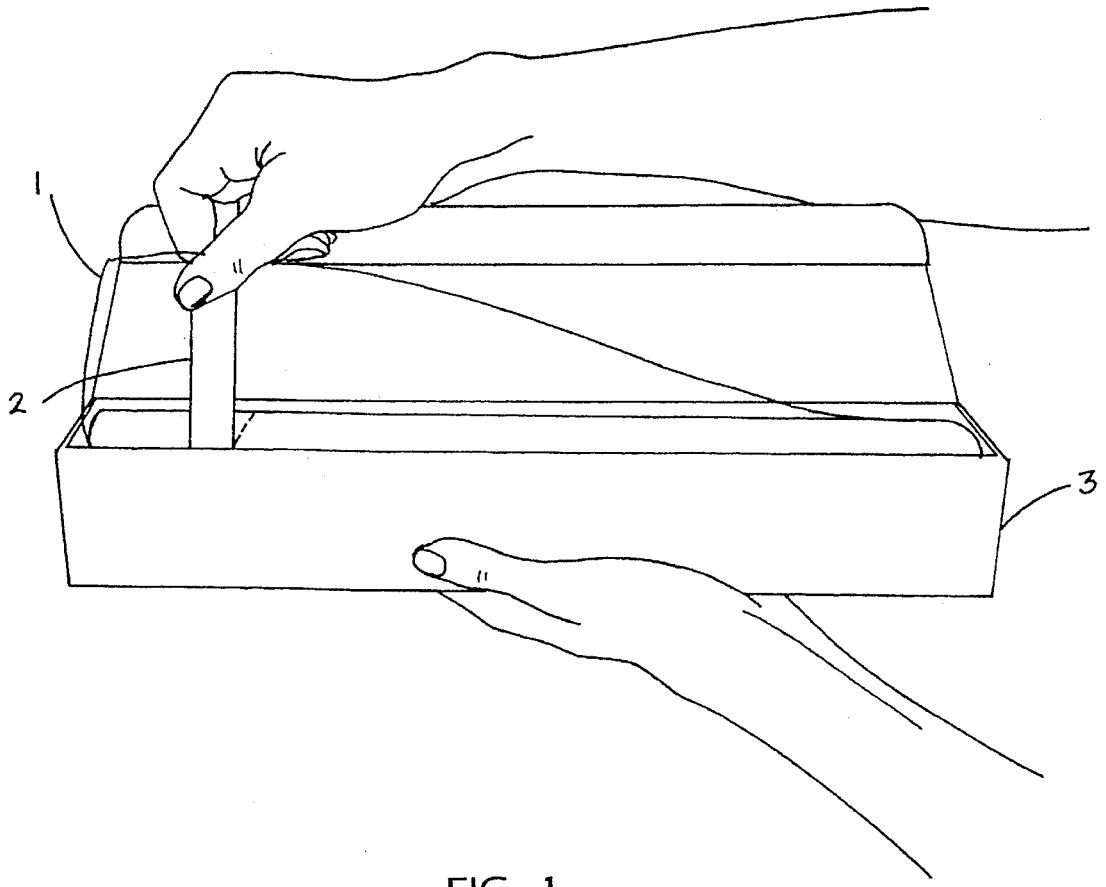
FIG. 1 shows a rolled sheet material in accordance with one embodiment of the present invention, in a packaging container.

FIG. 1 shows rolled sheet material 1, preferably a cellophane wrap material, bearing guide strip 2 and contained in packaging container 3. Guide strip 2 is preferably adhered to rolled sheet material 1 by a light, releasable adhesive. Guide strip 2 is provided with visible indicia 10.

Figure 2:
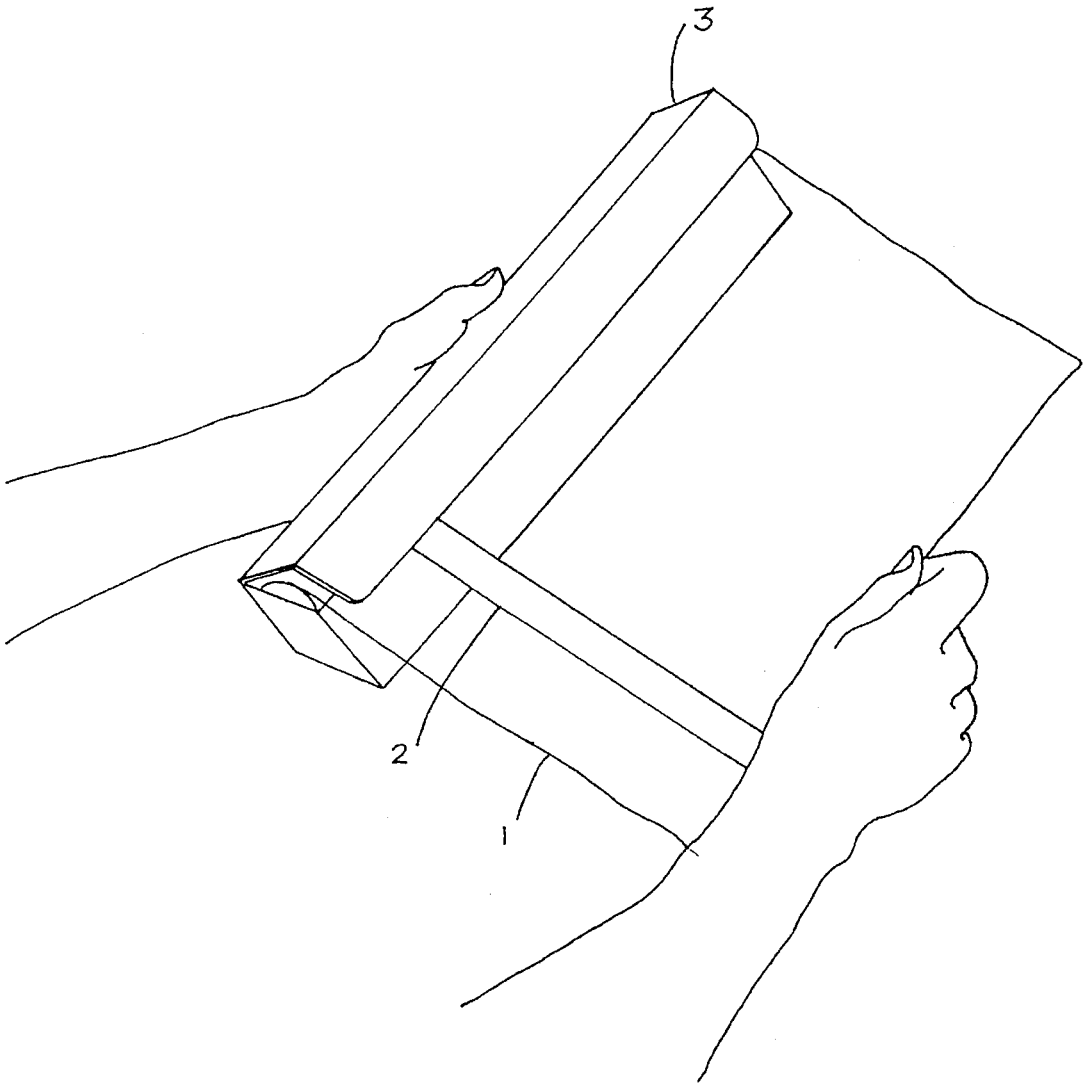
FIG. 2 shows a rolled sheet material in accordance with one embodiment of the present invention being unrolled from its packaging container.

FIG. 2 shows how rolled sheet material 1 may be drawn from the roll by grasping at or near the terminal end of the rolled sheet material 1 where the guide strip 2 also terminates. FIG. 1 and 2 also show how guide strip 2 acts as a visual and tactile cue to the user to allow the user to find the terminal edge of the rolled sheet material 1. Also, guide strip 2 acts as a visual indication of the coextensive length of the rolled sheet material which is being withdrawn from the roll, and may be ruled or otherwise contain indicia of length to allow the user to readily determine the coextensive length of the rolled sheet material which is being drawn from the roll.

Figure 3:
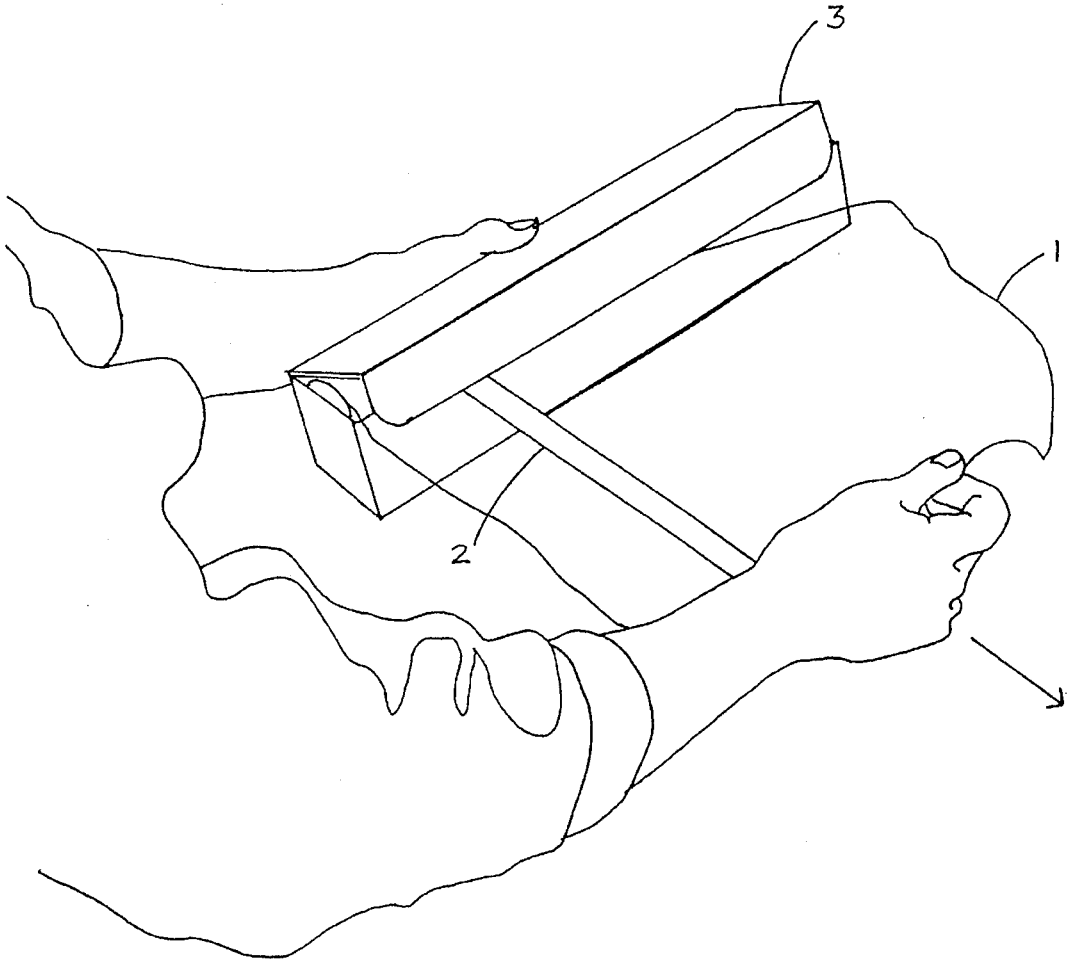
FIG. 3 shows a portion of a rolled sheet material in accordance with one embodiment of the present invention being taken from the packaging container.

FIG. 3 shows a portion of rolled sheet material 1 being tom from the roll with guide strip 2 still attached. The guide strip 2 is preferably made of a heavier material than the rolled sheet material, which helps to maintain the handling ability of the portion of rolled sheet material 1. The guide strip 2 helps to weigh down the portion of the rolled strip material 1 and, where it is made of a stiffer material, the guide strip 2 helps to keep the portion of rolled sheet material 1 straight. This is particularly important with cellophane wrap material, and similar materials, which have a high degree of tack and tend to self-adhere.

Figure 4:
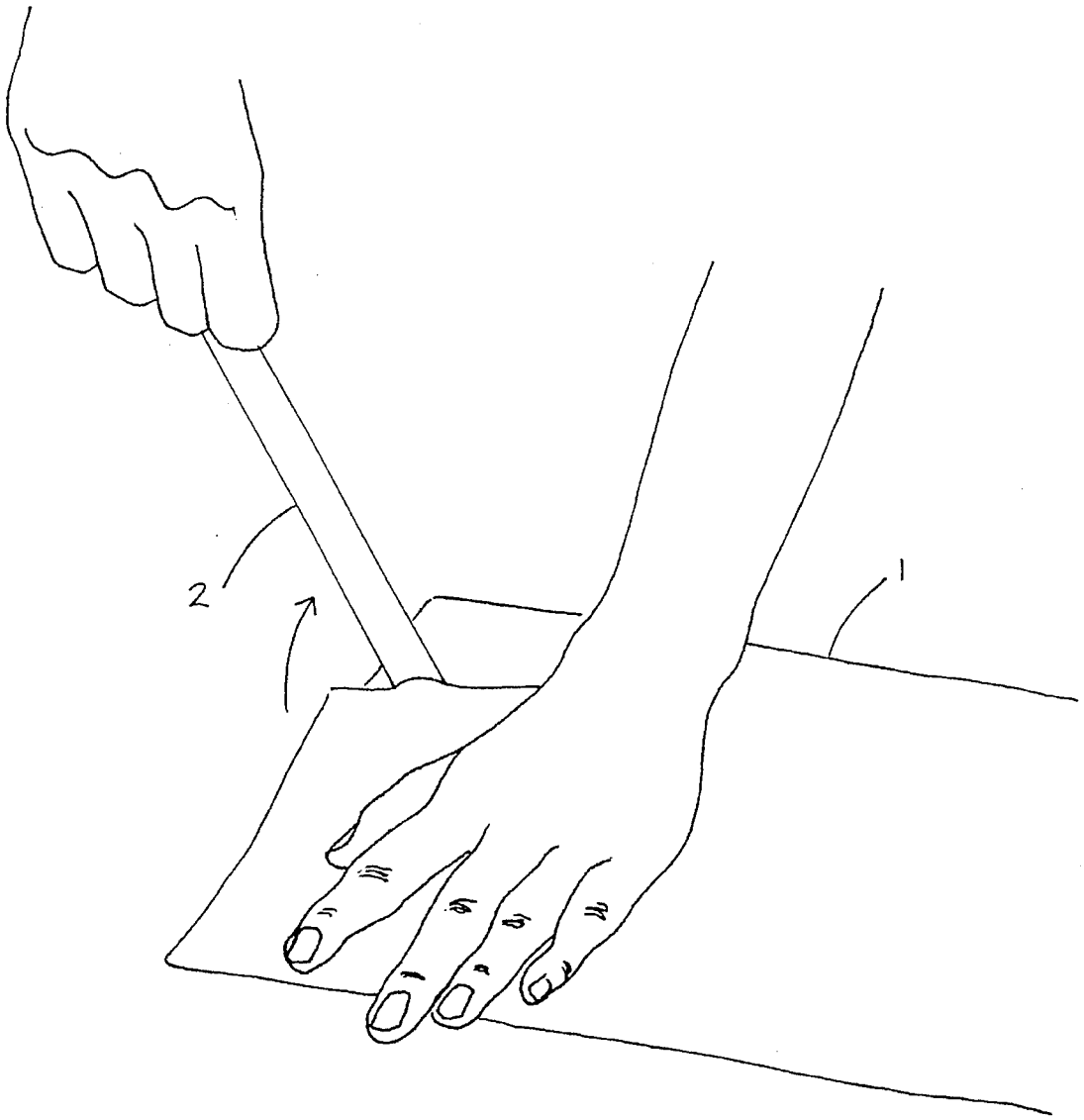
FIG. 4 shows a portion of a rolled sheet material in accordance with one embodiment of the present invention, having its guide strip removed.

FIG. 4 shows how guide strip 2 is removed from the surface of rolled sheet material 1. Guide strip 2 may be easily separated from rolled sheet material 1, even where a releasable adhesive is used. It is preferred that, where a releasable adhesive is used, that only a portion of the adhering surface of the guide strip material be provided with the releasable adhesive (preferably one side along its longitudinal axis), to make manual removal of the guide strip easier.

Figure 5:
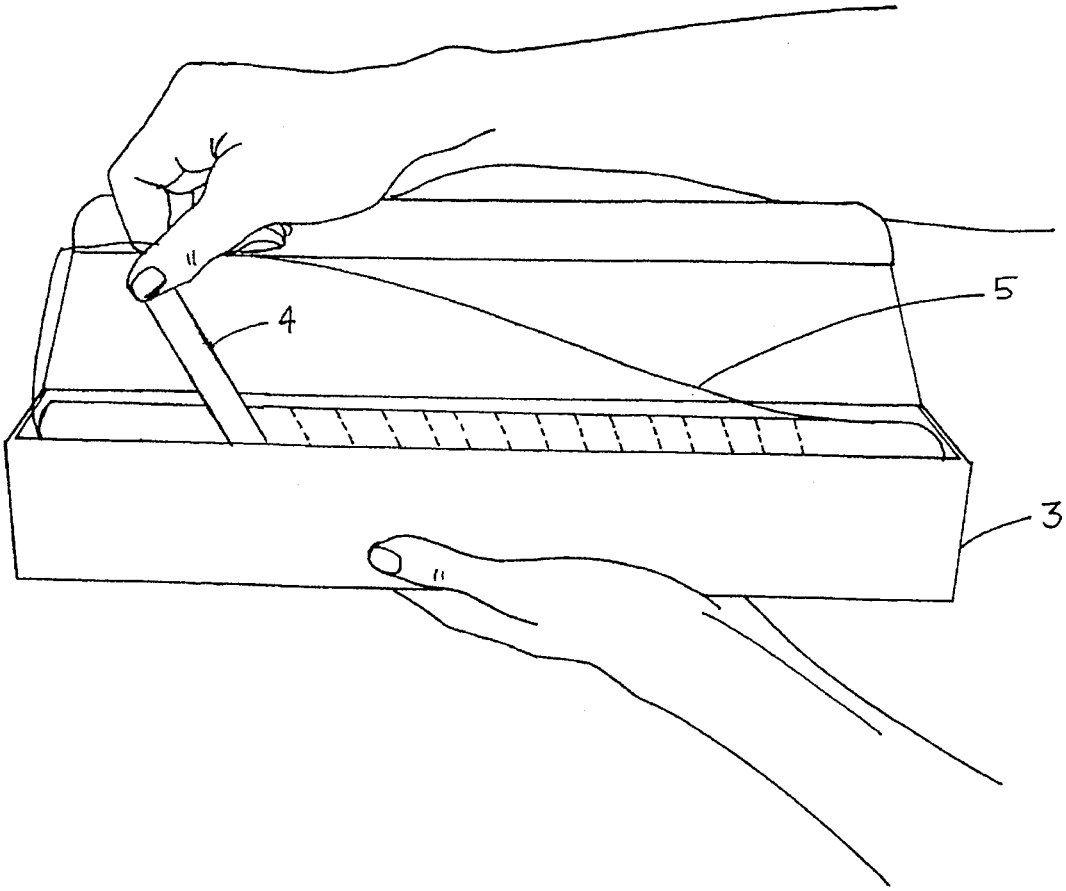
FIG. 5 is similar to FIG. 1 and shows a preferred embodiment of the present invention.
Figure 6:
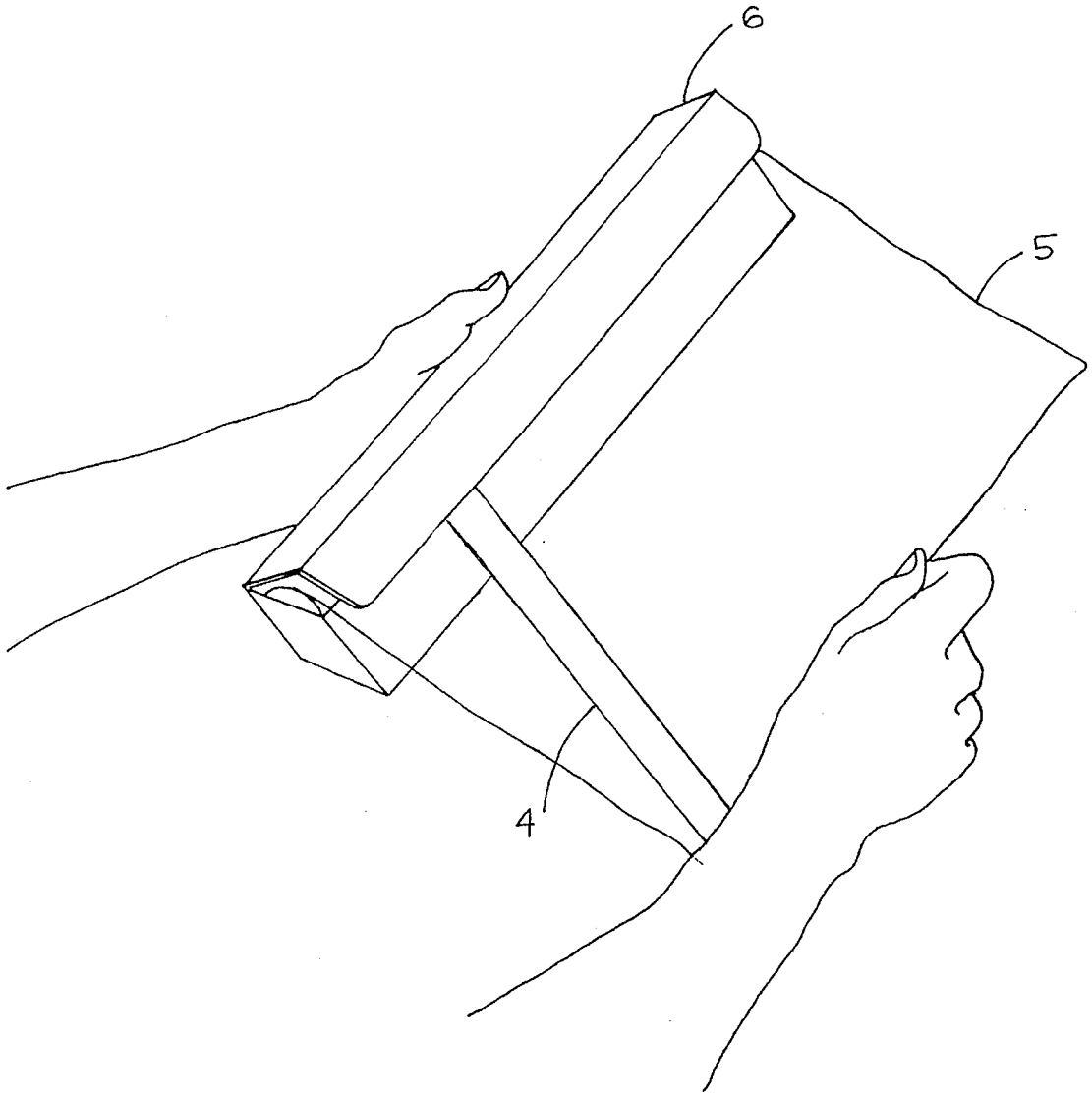
FIG. 6 is similar to FIG. 2 and shows a preferred embodiment of the present invention.
Figure 7:
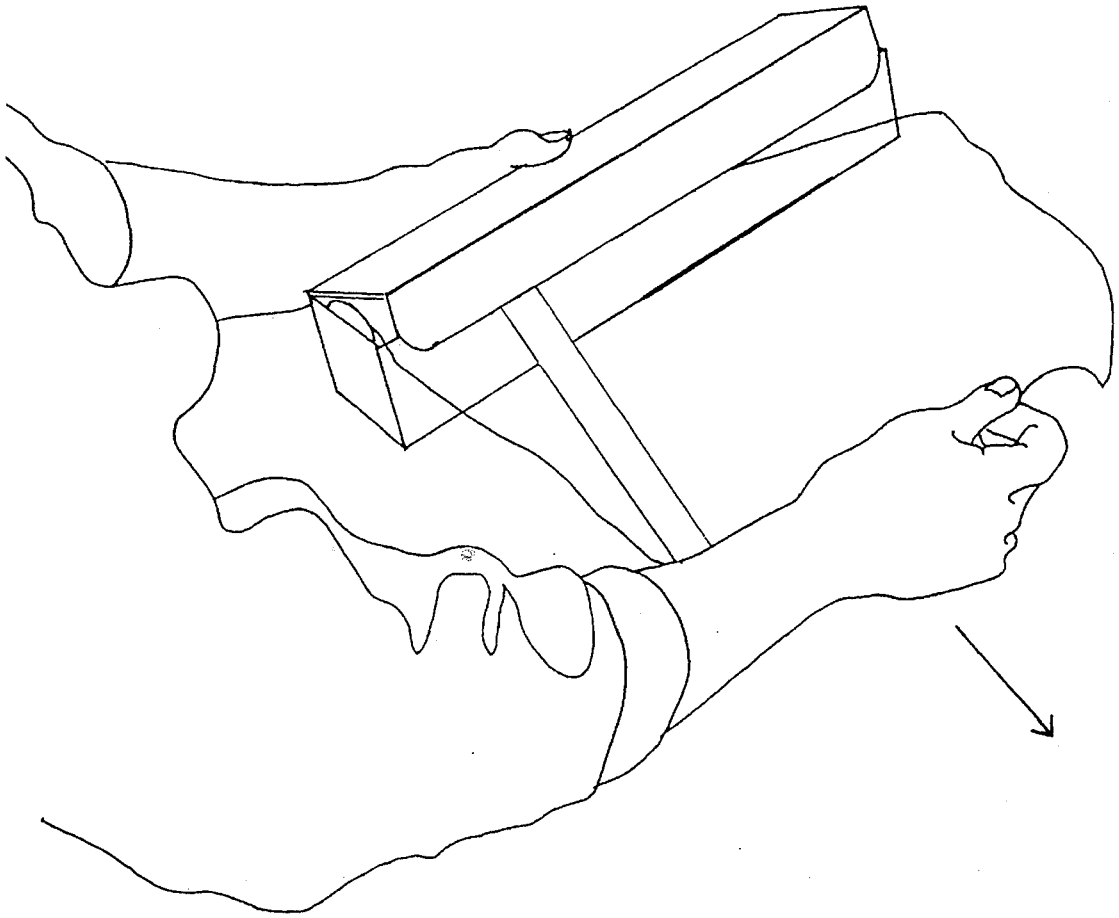
FIG. 7 is similar to FIG. 3 and shows a preferred embodiment of the present invention.

FIGS. 5, 6 and 7 show an alternative and most preferred embodiment of the present invention, similar to that depicted in FIGS. 1, 2 and 3. FIGS. 5, 6 and 7 show rolled sheet material 4 and guide strip 5, with guide strip 5 coiled through the rolled sheet material 4. This embodiment is preferred where it is desired to maintain the overall thickness of the material across its width, to make handling and packaging easier. The guide strip 5 may be removed from rolled sheet material 4 in the same way as is depicted in FIG. 4.

The roller sheet material having a releasable anti-tack guide strip of the present invention may be produced by methods of producing sheet material and methods of co-rolling two materials side-by-side, known and used in the plastics and paper field. For instance, the rolled sheet material of the present invention may be made using a slot-casting system such as that described in the Plastics Extrusion Technology Handbook authored by Sidney Levy and James Carley, Industrial Press, Inc., 200 Madison Avenue, New York, N.Y. 10016-4078, hereby incorporated herein by reference, particularly on page 108 thereof. Methods of co-rolling dissimilar materials known in the art may also be used to produce a rolled sheet material in accordance with the present invention. Such a system is shown on page 200 of the Plastics Extrusion Technology Handbook. The paper guide strip which may be used in accordance with one embodiment of the present invention may be applied onto the wind-up roll with a pressure guide roll, and it can be cut with a slitter roll. The strip may also be pre-cut and added to the roll. The paper strip may also be wound onto a pre-cut roll or onto a full roll and then cut. The paper guide strip is guided by guide rolls onto the wind-up roll.

In view of the foregoing disclosure, and or through practice of the present invention, it will be within the ability of one of ordinary skill to make alterations and modifications, including the substitution of equivalent materials and elements to be able to practice the invention without departing from its spirit as reflected in the appended claims.

What is claimed is:

1. A rolled sheet material having a guide strip, comprising:

a. a rolled sheet material having a lateral width, lateral sides, lateral edges and a longitudinal axis; and b. a guide strip disposed along one said lateral side of said rolled sheet material, said guide strip being coiled in a spiral so as to be substantially uniformly distributed between said lateral edges of said rolled sheet material, said guide strip being adhered to said rolled sheet material by a releasable adhesive and being releasable from said rolled sheet material, and said guide strip having a lateral width less them said lateral width of said rolled sheet material.

2. A rolled sheet material and guide strip according to claim 1 wherein said guide strip comprises paper.

3. A rolled sheet material having a guide strip, comprising:

a. a rolled polymeric sheet material having a lateral width, lateral sides, lateral edges and a longitudinal axis; and b. a paper guide strip disposed along one said lateral side of said rolled sheet material, said guide strip being coiled in a spiral so as to be substantially uniformly distributed between said lateral edges of said rolled sheet material, said guide strip being adhered to said rolled polymeric sheet material by a releasable adhesive, and having a lateral width less than said lateral width of said rolled sheet material.

4. A rolled sheet material and guide strip according to claim 3 wherein said rolled sheet material is cellophane.

5. A rolled sheet material and guide strip according to claim 3 wherein said guide strip is provided with visible indicia.

6. A rolled sheet material and guide strip according to claim 3 wherein said guide strip is provided with visible indicia adapted to measure a length of said rolled sheet material.

* * * * *

UNITED STATES PATENT AND TRADEMARK OFFICE

CERTIFICATE OF CORRECTION

PATENT NO. : 5,588,219

DATED : December 31, 1996

INVENTOR(S) : Jeffrey A. Seabrooks

It is certified that error appears in the above-indentified patent and that said Letters Patent is hereby corrected as shown below:

In column 2, line 58, please delete the word "tom" and replace it with -- torn --.

In column 4, line 17, please delete the word "them" and replace it with -- than --.

Signed and Sealed this

Tenth Day of June, 1997

*Attest:*

*Attesting Officer*

BRUCE LEHMAN

*Commissioner of Patents and Trademarks*